United States Patent [19]

Gartner

[11] Patent Number: 4,567,702

[45] Date of Patent: Feb. 4, 1986

[54] HEAT INSULATOR ASSEMBLY FOR CURTAIN WALL

[75] Inventor: Karl Gartner, Gundelfingen, Fed. Rep. of Germany

[73] Assignee: Yoshida Kogyo K.K., Tokyo, Japan

[21] Appl. No.: 519,196

[22] Filed: Aug. 1, 1983

[30] Foreign Application Priority Data

Aug. 9, 1982 [JP] Japan ..... 57-120891[U]

[51] Int. Cl.[4] ..... E04H 1/00

[52] U.S. Cl. ..... 52/235; 52/730; 49/DIG. 1

[58] Field of Search ..... 52/235, 403, 730, 732, 52/573, 394; 49/DIG. 1

[56] References Cited

U.S. PATENT DOCUMENTS

| | | | |
|---|---|---|---|
| 3,386,218 | 6/1968 | Scott | 52/394 X |
| 4,192,113 | 3/1980 | Martin, Jr. | 52/732 X |
| 4,453,355 | 6/1984 | Stoakes | 52/235 |

*Primary Examiner*—Carl D. Friedman

*Attorney, Agent, or Firm*—Hill, Van Santen, Steadman & Simpson

[57] ABSTRACT

A heat insulator assembly for an inclined curtain wall comprises a transom body having a plate inclined at a prescribed angle and interconnecting horizontal upper and lower base plates, and an outer member coupled to the inclined plate by a coupling bolt with a rigid heat insulating member being interposed between the outer member and the transom body, the bolt lying perpendicular to both the inclined plate and the outer member.

2 Claims, 4 Drawing Figures

HEAT INSULATOR ASSEMBLY FOR CURTAIN WALL

BACKGROUND OF THE INVENTION

This invention relates to a heat insulator assembly for a curtain wall, particularly a curtain wall of the inclined type.

The conventional heat insulator for a curtain wall is not designed for application to a curtain wall of the inclined type. Any attempt to use such a heat insulator as the insulator for an inclined curtain wall will result in deformation of an intervening heat insulating material when a coupling bolt is firmly tightened to couple the insulator together. This makes it impossible to obtain a heat insulator having sufficient strength.

SUMMARY OF THE INVENTION

It is an object of the present invention to provide a heat insulator assembly which solves the foregoing problem encountered in the prior art.

The heat insulator assembly for an inclined curtain wall of the present invention comprises a transom body having a plate inclined at a prescribed angle and interconnecting horizontal upper and lower base plates, and an outer member coupled to the inclined plate by a coupling bolt with a rigid heat insulating member being interposed between the outer member and the transom body, the bolt lying perpendicular to both the inclined plate and the outer member.

DESCRIPTION OF THE PREFERRED EMBODIMENT

Figure 1:
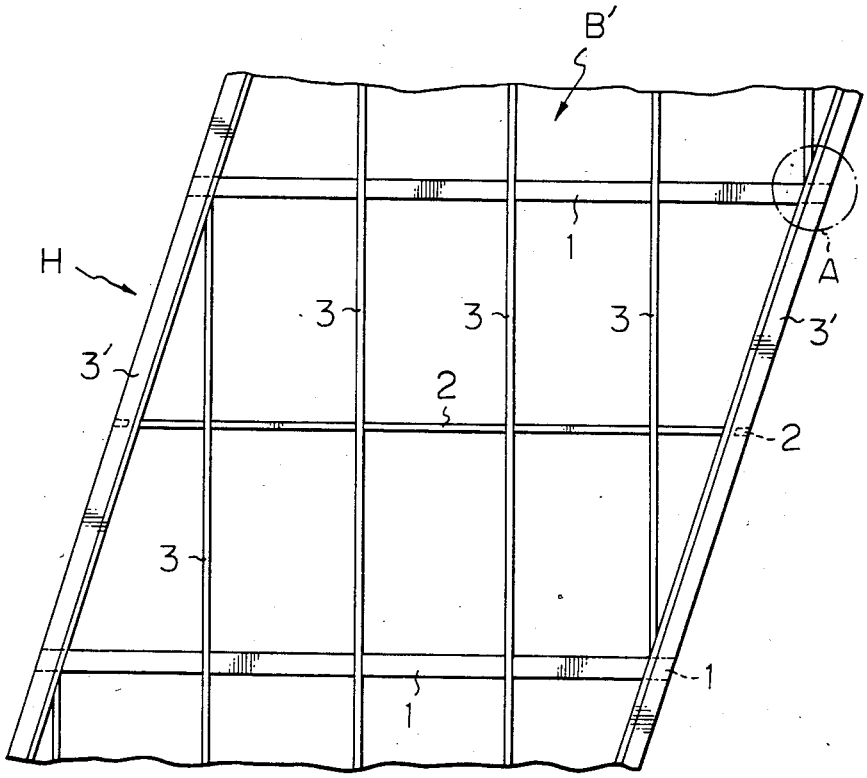
FIG. 1 is a side view of a building provided with inclined curtain walls.

Referring to the side view of FIG. 1 showing an inclined curtain wall H, numeral 1 denotes a transom, 2 an intermediate transom, and 3 a vertical mullion. The transom 1, intermediate transom 2 and vertical mullion 3 are arranged in the form of a lattice or grid, with side vertical mullions 3', 3' being disposed at an incline along the inclined front and back surfaces of a building B'. The encircled portion A in FIG. 1 is shown in greater detail in the enlarged, longitudinal section of FIG. 2.

Figure 2:
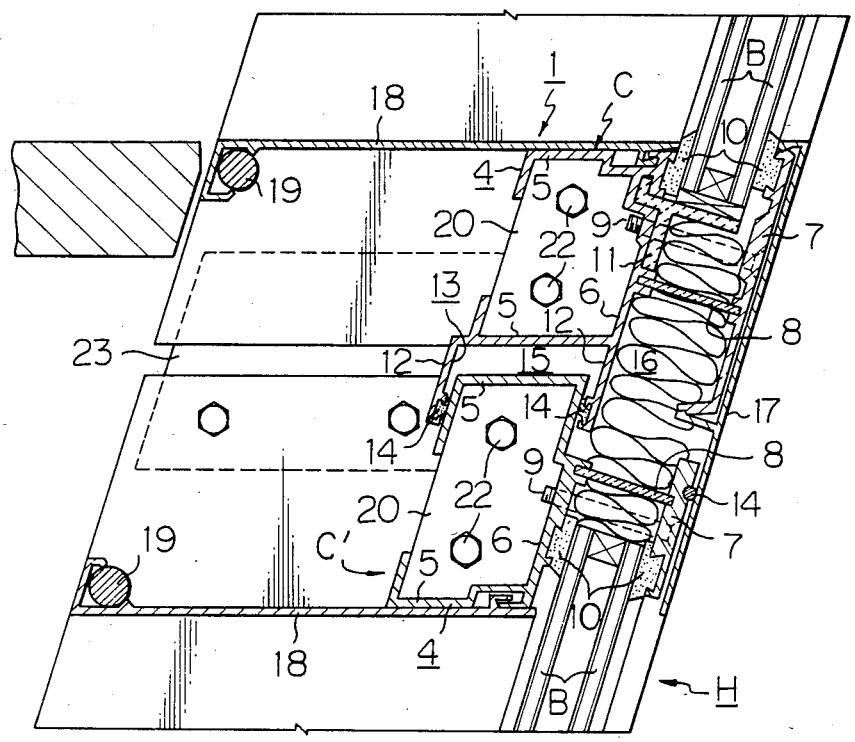
FIG. 2 is an enlargd, longitudinal sectional view of portion A shown in FIG. 1.

With reference to FIG. 2, numeral 4 designates a transom body, specifically a structual member on the inner side of the curtain wall. The transom body 4 comprises a pair of substantially parallel upper and lower base plates 5, 5 extending horizontally, and an inclined plate 6 interconnecting the base plates 5, 5 and extending at a predetermined angle of inclination with respect thereto. An outer structural member 7 is disposed to lie in parallel with the inclined plate 6 with a clearance therebetween. A rigid heat insulating member 8 is interposed between the transom body 4, serving as the inner structural member, and the outer structural member 7, and is arranged to meet these members at right angles. A coupling bolt 9 is passed through the outer structural member 7 in the vicinity of the insulating member 8 and is screwed into the transom body 4, leaving a space between the transom body and the outer structural member. Tightening the coupling bolt 9 couples the transom body 4 and outer structural member 7 together through the intermediary of the heat insulating member 8. Note that the coupling bolt 9 is screwed into place and tightened while maintaining a parallel relationship with respect to the heat insulating member 8. In other words, when screwed in place, the coupling bolt lies perpendicular to both the outer structural member 7 and the inclined plate 6 of the transom body 4.

The foregoing constructs a heat insulator structure for an inclined curtain wall in accordance with the present invention.

Double glass panes B, shown in FIG. 2, are fixedly embraced by the outer structural member 7 and the base end of the base plate 5 via gaskets 10, 10. The bottom surfaces of the double glass panes B are supported by a glass pane supporting fitting 11.

A lower heat insulator structure C' is connectd to the upper heat insulator structure C of FIG. 2 and is capable of being displaced relative thereto. More specifically, the lower base plate 5 of the upper heat insulator structure C is provided with extension pieces 12, 12 projecting from both ends thereof and forming a cavity 13. The lower heat insulator structure C' has its upper base plate 5 fitted into the cavity 13 through the intermediary of hermetic sealing members 14, 14, whereby the lower heat insulator structure C' is connected to the upper heat insulator structure C so as to be horizontally displaceable relative thereto. In the connected state, a space 15 is formed between the lower base plate 5 of the upper insulator structure C and the upper base plate 5 of the lower insulator structure C'. The space 15 maintains the hermetic seal, offsets mechanical error and absorbs thermal expansion and contraction.

A fibrous heat insulating material 16 such as glass wool or rock wool is packed between the inclined plate 6 of the transom body 4 and the outer structural member 7 to improve the heat insulating property of the heat insulator assembly.

An outer batten 17 is attached across the outer structural members 7, 7 of the respective upper and lower insulator structures C, C' through the intermediary of a sealing member 14 to cover the joint and, hence, maintain both air and water tightness.

The transom 1 is constructed by fitting covers 18, 18 onto the respective base plates 5, 5 situated on the outer sides of the upper and lower insulator structures C, C'. The ends of the covers 18, 18 are supported by cover supporting rods 19, 19 provided astride adjacent vertical mullions 3, 3. The transom body 4 is coupled to and supported by a vertical mullion body 21, described later, through a transom coupling block 20 by means of coupling bolts 22. Upper and lower mullions 3, 3 are connected by a sleeve 23 so as to be relatively displaceable.

Figure 4:
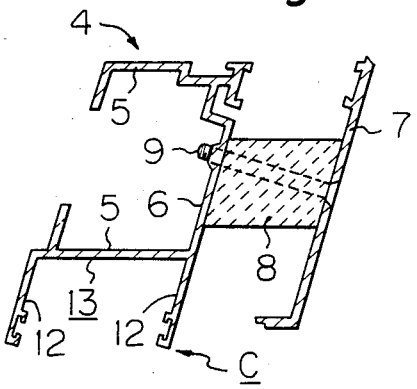
FIG. 4 is a sectional view showing another embodiment of a heat insulator.

FIG. 4 illustrates a modification of the arrangement for coupling the inclined plate 6 and outer structural member 7 in the heat insulator structure C. If the coupling bolt 9 is passed through the outer structural member 7 and is screwed into the inclined plate 6 in such fashion as to lie perpendicular to both elements, as shown in FIG. 4, then the heat insulating member 8 interposed between the inclined plate 6 and outer structural member 7 may have the configuration of a parallelogram when viewed from the side thereof, and the coupling bolt 9 may be passed through the heat insulating member 8 if desired.

Figure 3:
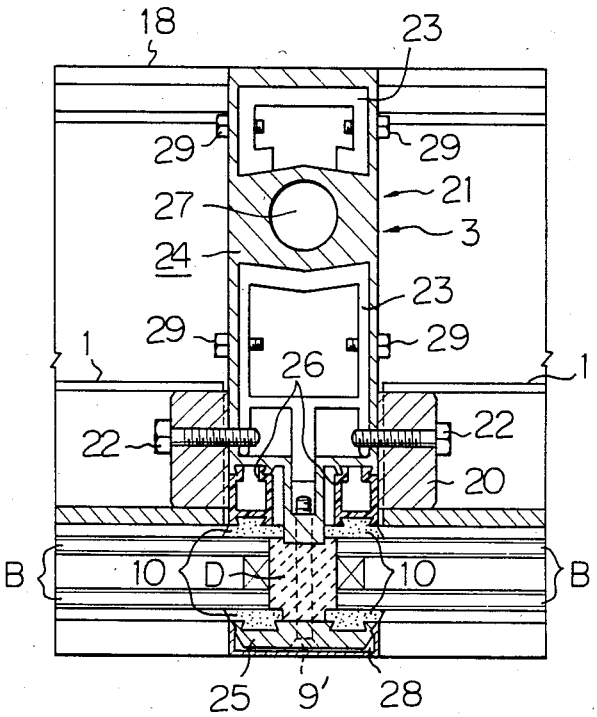
FIG. 3 is a transverse sectional view illustrating a transom coupling portion.

Reference will now be had to the transverse sectional view of FIG. 3 illustrating the portion where the transoms 1, 1 are coupled together. As shown, a vertical mullion body 24 and an outer structural member 25 are coupled together with a heat insulating member D interposed therebetween, with double glass panes B, B being disposed on both sides of the insulating member D. Specifically, double glass panes B are fixedly secured, through the gaskets 10, 10, in a channel formed by the outer structural member 25, the insulating member D, and an attachment 26 fitted in the vertical mullion body 24.

As described earlier, the transom bodies 4, 4 constructing the transom 1 are coupled by the coupling bolts 22 to both sides of the vertical mullion body 24 through the transom coupling blocks 20, 20, whereby the transom bodies 4, 4 are supported by the vertical mullion body 24. Each of the covers 18, 18 extends between the corresponding transom both 4 and the cover supporting rod 19 bridging the end portions of adjacent mullion bodies 24.

As shown in FIG. 3, the vertical mullion body 21 constructing the vertical mullion 3 has a rectangular cross-section and is formed to include a heat transfer medium flow passage 27 at substantially the central portion thereof as seen in the drawing. The outer side of the outer structural member 25 coupled to the vertical mullion body 21 is covered by a vertical mullion cover 28. The upper and lower vertical mullion bodies 24, 24 are interconnected for vertical movement via the sleeve 23 by sleeve fixing bolts 29.

Owing to the construction of the present invention illustrated hereinabove, a heat insulator assembly for an inclined curtain wall in accordance with the present invention has the following advantages:

(1) An inclined curtain wall employing the heat insulator assembly of the invention exhibits the high heat insulating performance that is required of such walls.

(2) Coupling bolts can be tightened securely without causing deformation of the heat insulating material, thereby providing a heat insulator assembly having excellent mechanical strength.

Although a certain preferred embodiment has been shown and described, it should be understood that many changes and modifications may be made therein without departing from the scope of the appended claims.

What is claimed is:

1. A heat insulator assembly for an inclined curtain wall, comprising:

a transom body which includes a horizontally extending base plate and an upper, inner insulator structure and a lower, inner insulator structure on opposed sides of said base plate, a pair of extensions projecting from both ends of the base plate, said extensions forming a cavity between them, and said lower, inner insulator structure having its upper end fitted into the cavity through the intermediary of hermetic sealing members, whereby said lower, inner heat insulator structure is connected to said upper, inner heat insulator structure so as to be horizontally displaceable relative thereto, wherein said upper, inner insulator structure and said lower, inner insulator structure are coupled to respective individual outer structural members, both of said outer structural members being interconnected air- and water-tightly through a sealing member by an outer batten bridging both of said outer structural members.

2. A heat insulator assembly for an inclined curtain wall, comprising:

a transom body which includes a horizontally extending base plate and an upper, inner insulator structure and a lower, inner insulator structure on opposed sides of said base plate, a pair of extensions projecting from both ends of the base plate, said extensions forming a cavity between them, and said lower, inner insulator structure having its upper end fitted into the cavity through the intermediary of hermetic sealing members, whereby said lower, inner heat insulator structure is connected to said upper, inner heat insulator structure so as to be horizontally displaceable relative thereto, wherein said transom body base plate is one of a pair of upper and lower base plates extending horizontally and said transom body further includes an inclined plate interconnecting said base plates and extending at a predetermined angle of inclination with respect thereto; and further comprising an outer structural member disposed to lie in parallel with and spaced away from the inclined plate of said transom body, a rigid heat insulating member interposed between said transom body and said outer structural member, and a coupling bolt screwed perpendicularly through the inclined plate of said transom and said outer structural member for coupling said transom and said outer structural member together.

* * * * *